United States Patent [19]

Nelson et al.

[11] 4,340,355

[45] Jul. 20, 1982

[54] FURNACE CONTROL USING INDUCED DRAFT BLOWER, EXHAUST GAS FLOW RATE SENSING AND DENSITY COMPENSATION

[75] Inventors: Lorne W. Nelson, Bloomington; Ralph H. Torborg, Minnetonka, both of Minn.

[73] Assignee: Honeywell Inc., Minneapolis, Minn.

[21] Appl. No.: 146,885

[22] Filed: May 5, 1980

[51] Int. Cl.[3] ..... F23N 3/00

[52] U.S. Cl. ..... 431/20; 431/12; 236/15 BD

[58] Field of Search ..... 431/12, 20, 75, 76, 431/90; 236/1 G, 14, 15 BD, 15 E, 45; 126/110 R, 285 B; 110/163

[56] References Cited

U.S. PATENT DOCUMENTS

| | | | |
|---|---|---|---|
| 1,707,281 | 4/1929 | Sauvage | 110/162 |
| 1,743,731 | 1/1930 | Scott | 126/116 A |
| 1,773,585 | 8/1930 | Klockau | 126/285 B |
| 1,957,902 | 5/1934 | Oakes | 431/90 |
| 2,011,754 | 8/1935 | Cornelius | 126/110 A |
| 2,218,930 | 10/1940 | Cunningham | 137/494 |
| 2,262,252 | 11/1941 | Roland | 109/45 |
| 2,296,410 | 9/1942 | Wetzsteon | 236/45 |
| 2,381,223 | 8/1945 | Miller | 110/101 C |
| 2,448,891 | 9/1948 | Katz | 126/290 |
| 2,691,413 | 10/1954 | Leslie et al. | 126/110 R |
| 3,280,774 | 10/1966 | English | 110/162 |
| 3,307,613 | 3/1967 | Rexer | 431/76 |
| 3,768,956 | 10/1973 | Mueller et al. | 431/20 |
| 3,814,570 | 6/1974 | Guigues et al. | 431/90 |
| 3,869,243 | 3/1975 | Creuz | 431/90 |
| 4,017,024 | 4/1977 | Gostick et al. | 236/16 |
| 4,033,712 | 7/1977 | Morton | 431/90 |
| 4,108,369 | 8/1978 | Prikkel | 236/1 G |
| 4,189,295 | 2/1980 | Ramon | 431/12 |
| 4,251,025 | 2/1981 | Bonne et al. | 236/14 |

*Primary Examiner*—Samuel Scott
*Assistant Examiner*—Lee E. Barrett
*Attorney, Agent, or Firm*—Clyde C. Blinn; Stuart R. Hemphill

[57] ABSTRACT

An induced draft combustion apparatus and its associated control system has a blower located in the exhaust stack or vent which is used to induce the movement of air and combustion products into, through and out of the combustion chamber. A flow-restricting orifice in the exhaust stack near the blower causes a region of higher pressure to exist upstream from the orifice with a region of lower pressure downstream from the orifice. An exhaust gas pressure signal representative of the exhaust gas volume flow rate is sensed on one side of the orifice and is fed back to a modulating gas valve which controls the outlet gas flow from the valve to be proportional to the magnitude of the exhaust gas volume flow rate. By controlling blower speeds and exhaust gas volume flow capacities as related to a selected orifice size, various firing rates for the furnace can be selected, from the design maximum down to various derated levels. Temperature-sensitive devices cooperating with the stack orifice or with the modulating gas valve are employed to compensate for changes in the density of the exhaust gas which accompany startup and changes in firing rate.

18 Claims, 9 Drawing Figures

FURNACE CONTROL USING INDUCED DRAFT BLOWER, EXHAUST GAS FLOW RATE SENSING AND DENSITY COMPENSATION

BACKGROUND OF THE INVENTION

1. Field of the Invention

This invention relates to combustion heating systems and control apparatus for such systems. More specifically, this invention relates to apparatus for constructing a furnace and its control system, to produce an induced draft furnace having increased efficiency.

2. Description of the Prior Art

Conventional gas-fired, natural draft furnace systems typically operate at a steady-state efficiency of about 75%. The seasonal average efficiency of such furnace systems is usually considerably lower, on the order of 60%. As the cost of gas and other fuels used for heating rises, and as such fuels grow scarcer, these levels of efficiency are considered less and less acceptable, and various ways of increasing furnace system efficiency are sought.

Several methods of increasing furnace efficiency are known in the prior art. For example, it is known that significant efficiency-reducing losses occur due to the escape of heat up the flue, vent, or exhaust stack during the portion of the furnace cycle when the burner is off. This heat is primarily heat taken from the burner heat exchanger following a burning cycle. One prior art solution to this form of heat loss is to provide dampers of various kinds which permit draft flow when required for the burning cycle, but serve to limit draft flow when the burner is not on. Examples of such dampers may be seen in the following U.S. Pat. Nos. 1,743,731; 1,773,585; 2,011,754; 2,218,930; 2,296,410; 4,017,024 and 4,108,369. As these patents show, a damper having the desired effect can be placed so as to limit exhaust draft flow out of the combustion chamber or input air flow into the combustion chamber.

A second form of efficiency-reducing loss in furnaces occurs due to inefficient burning as a result of improper air-fuel ratio. The prior art shows several methods for controlling fuel and/or air flow in order to maintain the air-fuel ratio as close as possible to the chemical ideal of stoichiometric burning, in which all fuel and oxygen would be completely combusted. Such prior art arrangements include U.S. Pat. No. 3,280,774, which shows an orifice plate of pre-selected cross-section and draft-limiting characteristics combined with a draft blower fan, and U.S. Pat. No. 2,296,410, which shows an apparatus for mechanically linking a modulating fuel regulator to a draft damper, to regulate the air supply in relation to the fuel supply.

A third form of efficiency-reducing loss in furnaces occurs due to the heat exchange process. Because it is impossible to transfer all the heat from the combustion chamber to the circulated air, water or other heat delivery medium, a certain amount of unabsorbed heat passes out of the heat exchanger and up the exhaust stack. One known way of reducing this type of loss is to derate the furnace, i.e., operate it at a lower firing rate. This permits a higher percentage of the heat produced by combustion to be absorbed in the heat exchanger. An example of a prior art patent disclosing a burner using derating is U.S. Pat. No. 3,869,243.

There are, however, certain disadvantages which may accompany a reduced firing rate. In particular, the following may arise: (1) slower response time in reaching the thermostatically selected room temperature; (2) possible inability to achieve the selected temperature; (3) increased condensation on the inside walls of the furnace chamber, or the interiors of tubing, valves, etc., associated with the furnace, leaading to more rapid corrosion, rusting or other deterioration of such parts; and (4) mismatching of fuel and air ratios, often leading to high excess air conditions at firing rates below the design maximum.

SUMMARY OF THE INVENTION

The present invention involves an induced draft combustion apparatus and its associated control system, for producing an induced draft furnace having increased efficiency. With the present invention, a blower located in the exhaust stack or vent is used to induce the movement of air and combustion products into, through and out of the combustion chamber. A flow-restricting orifice means in the exhaust stack in proximity to the blower causes a region of higher pressure to exist upstream from the orifice with a region of lower pressure downstream from the orifice. An exhaust gas pressure signal representative of the exhaust gas volume flow rate is sensed on one side of the orifice and is fed back to a modulating gas valve which controls the outlet gas flow from the valve to be proportional to the magnitude of the exhaust gas volume flow rate. By controlling blower speeds and exhaust gas volume flow capacities as related to a selected orifice size, various firing rates for the furnace can be selected, from the design maximum down to various derated levels.

With the present invention a significant improvement to the above-described arrangement (which is disclosed in the commonly-assigned U.S. Pat. No. 4,251,025 issued Feb. 17, 1981, listing as inventors Ulrich Bonne et al.) is achieved, by use of means for modifying operation of the modulating gas valve to compensate for changes in exhaust gas density. As the firing rate of the furnace changes, the temperature and density of the exhaust stack gas changes and, with it, the mass flow of combustion air into the system for a given exhaust gas pressure and exhaust gas volume flow rate. In particular, due to density differences, the mass flow of exhaust gas at a given exhaust gas pressure is lower at a high exhaust gas temperature than at a low temperature. The lower exhaust gas mass flow also results in lower mass flow of incoming air for a given exhaust gas volume flow rate.

With derating, the exhaust gas temperature decreases, its density increases and the mass flow of incoming combustion air is higher for a given exhaust gas volume flow rate. The net result of derating a system by decreasing the volume delivery rate of the blower (typically by reducing its speed) is a decreased fuel supply rate which is not accompanied by a commensurate decrease in the mass flow rate of incoming combustion air. For example, a system may be derated by decreasing the volume delivery rate of the blower by half, but the increased density of the exhaust gas makes the mass reduction in incoming combustion air less than half. An excess air condition will arise and decrease combustion efficiency.

With the present invention, the excess air condition which results from derating can be controlled by sensing the temperature and, thus, the density of the exhaust gas and increasing the fuel supply rate relative to the combustion air flow rate for the lower exhaust gas temperatures associated with lower firing rates. The present invention discloses two different means for accomplishing this. First, means are disclosed for reducing the effective size of the stack orifice with lower exhaust gas temperatures. This constriction causes the pressure upstream from the orifice to increase for a given exhaust gas flow rate, resulting (in the pressure feedback control system disclosed herein) in an increased fuel supply rate and, thus, reduced excess air at lower exhaust gas temperatures. Second, means are disclosed for reducing the feedback effect of a given exhaust gas pressure level at higher exhaust gas temperatures or, alternately, for increasing the feedback effect of a given exhaust gas pressure level at lower exhaust gas temperatures. In either case, for a given exhaust gas pressure, a relatively greater flow of fuel is delivered to the burner at lower exhaust gas temperatures than at higher temperatures, resulting in reduced excess air at lower firing rates. Both means for modifying the feedback effect of a given exhaust gas pressure are implemented with a circuit including a temperature-sensitive resistance in series with a resistance heating element. The heating element heats a bimetal element located in and connected to the fuel supply means to increase or decrease the flow of fuel in the appropriate manner.

The principal objects of the present invention are to provide an improved furnace or heating apparatus design and control system which: (a) provides improved steady-state and seasonal efficiency as compared to conventional natural draft furnaces; (b) utilizes an induced draft blower, an exhaust gas flow rate feedback signal and exhaust gas temperature sensing to control burner fuel flow; (c) utilizes exhaust gas pressure sensing to reduce high excess air combustion conditions, particularly when the furnace is derated; and (d) utilizes exhaust gas density sensing to reduce high excess air at lower furnace firing rates.

BRIEF DESCRIPTION OF THE DRAWINGS

In the accompanying drawings forming a material part of this disclosure.

FIG. *2a* is a detail of the induced draft blower, the exhaust stack and orifice and the temperature sensing component which increases the flow restricting effect of the orifice with lower stack temperatures.

FIG. *2b* is a detail of the induced draft blower, the exhaust stack and orifice and the temperature sensing component which controls heating of the bimetal elements shown in FIGS. *6a* and *6b*.

FIG. *3a* is a schematic diagram of the modulating gas valve used in the present invention shown in the "off" position.

FIG. *3b* is a schematic diagram of the modulating gas valve used in the present invention shown in the "on" position.

Figure 4:
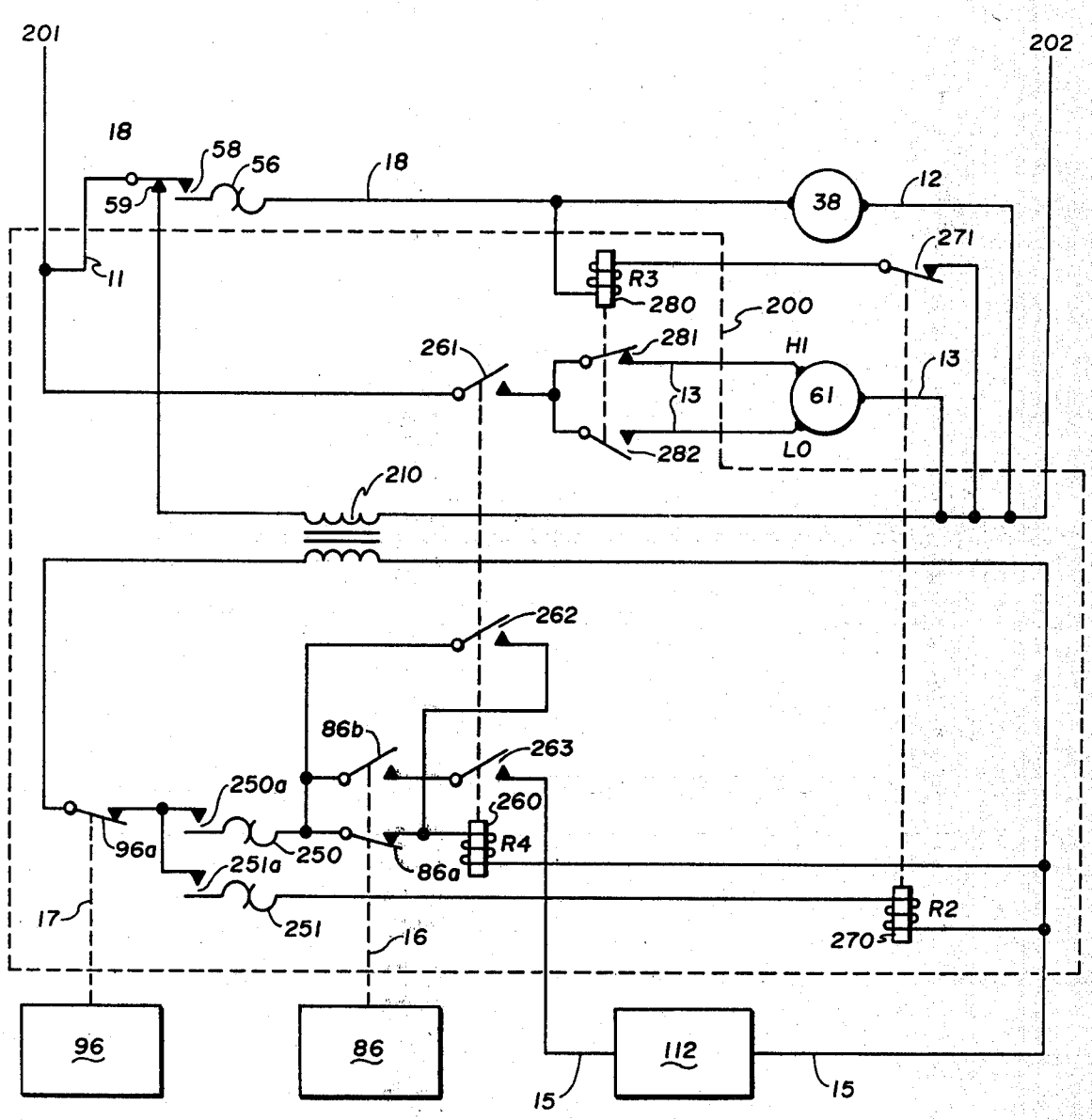

FIG. 4 is an electrical schematic of a two-stage thermostat control system used in connection with the embodiment of the present invention shown in FIG. *2a*.

Figure 5:
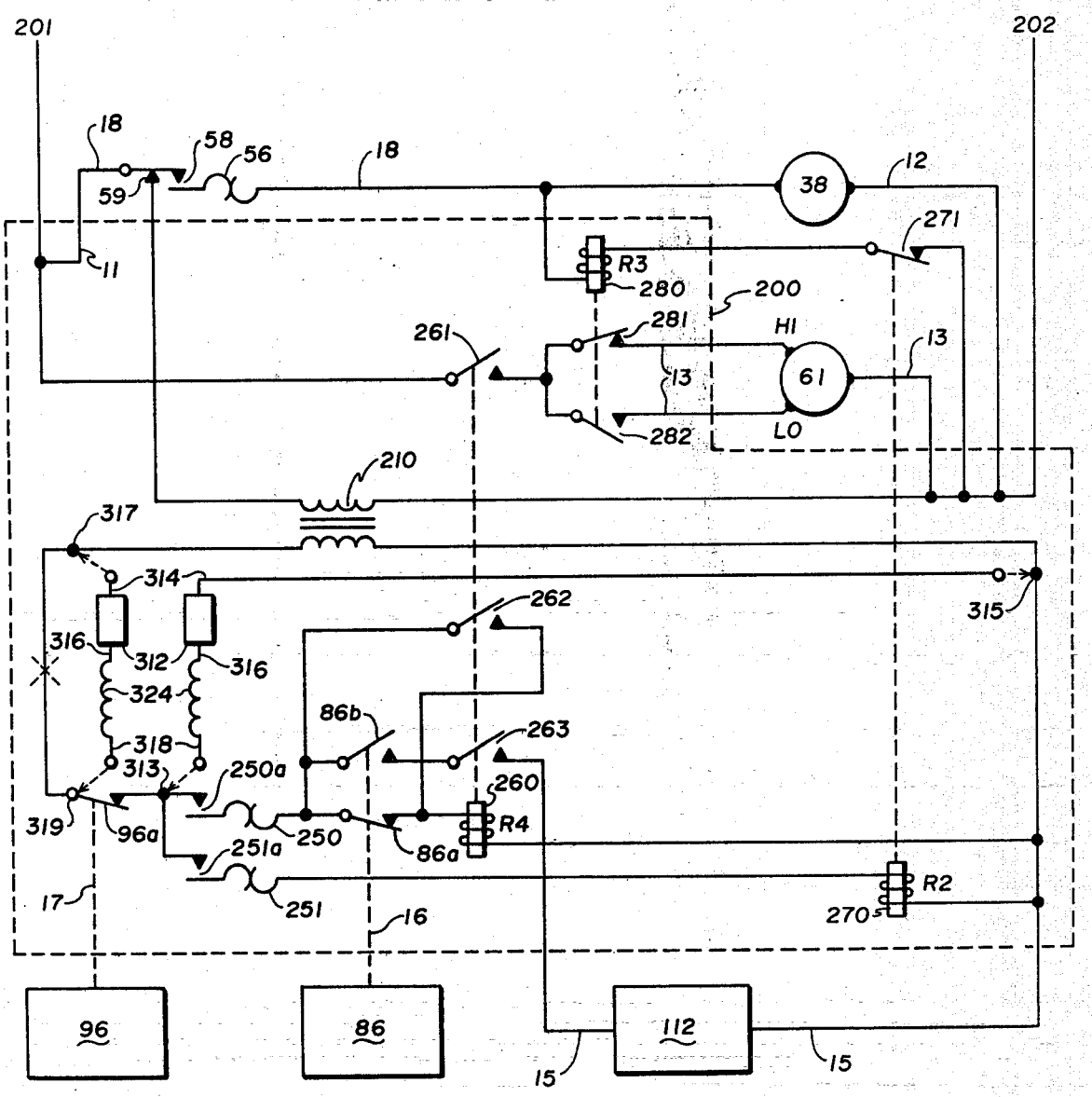

FIG. 5 is an electrical schematic of a two-stage thermostat control system used in connection with the embodiment of the present invention shown in FIGS. *2b*, *6a* and *6b*.

FIG. *6a* is a schematic diagram of a portion of the modulating gas valve shown in FIGS. *3a* and *3b*, as adapted for use with a negative temperature coefficient sensor and resistance heater, as further shown in FIGS. *2b* and 5.

FIG. *6b* is a schematic diagram of a portion of the modulating gas valve shown in FIGS. *3a* and *3b*, as adapted for use with a positive temperature coefficient sensor and resistance heater, as further shown in FIGS. *2b* and 5.

DESCRIPTION OF THE INVENTION

Description of Preferred and Alternate Embodiments a. General Configuration of Furnace and Control System

Figure 1:
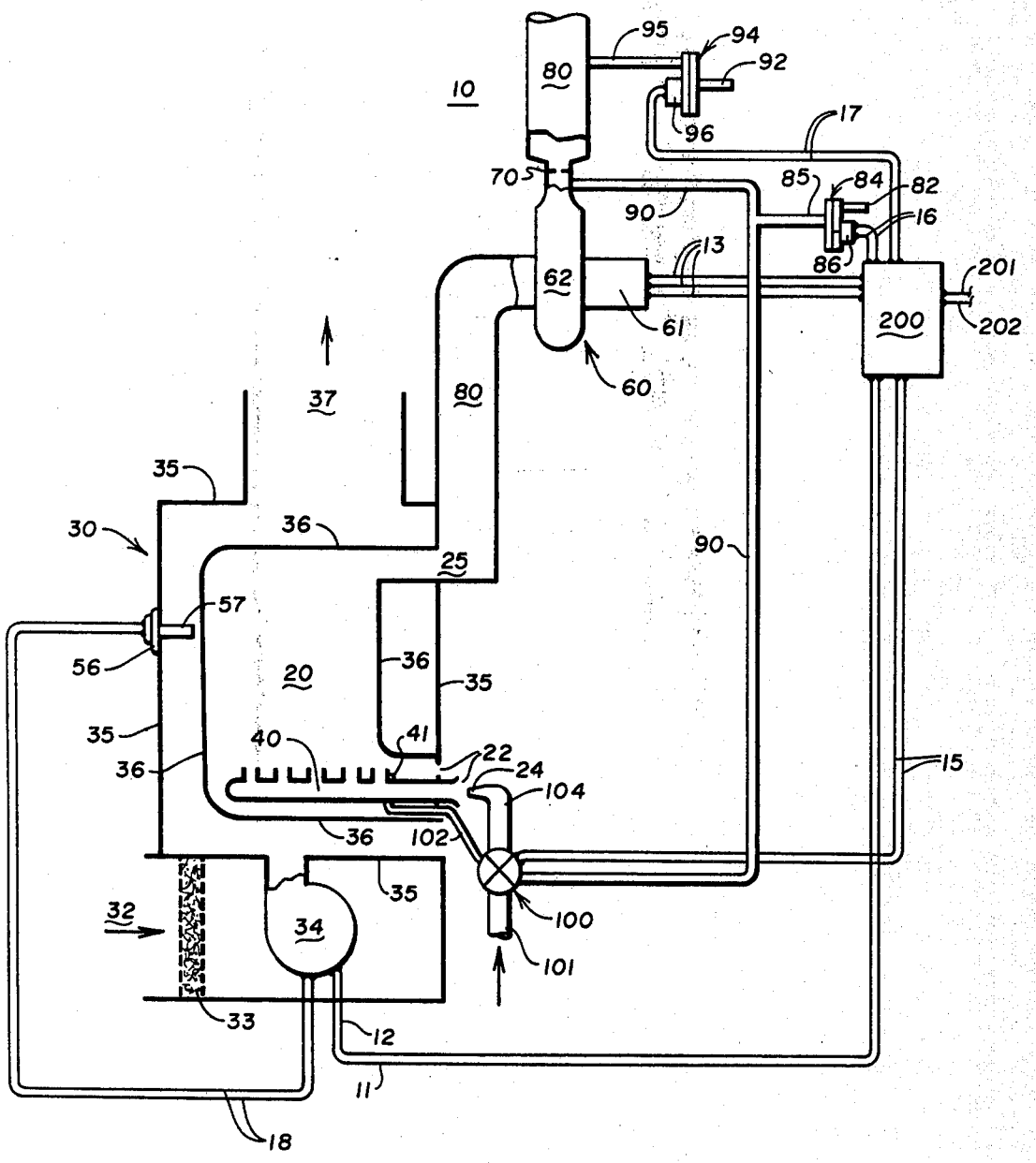
FIG. 1 is a schematic drawing of the furnace and the basic control system of the present invention, using an orifice downstream from the induced draft blower and a pressure feedback signal, to which exhaust gas density compensating elements are added as shown in FIGS. *2a* and *2b*.

A furnace and furnace control system 10 in accordance with the present invention consists generally, as shown in FIG. 1, of one or more combustion chambers 20, each of which has a burner 40 located near its bottom and is substantially enclosed by exterior walls 36. Fuel, which in the preferred embodiment is a gas such as natural gas or liquified petroleum, is fed to the burner 40 by a gas outlet 24 near the mouth of the burner 40. Air enters the burner 40 and the combustion chamber 20 at air inlets 22, located near the tip of the gas outlet 24 and the mouth of the burner 40. A pilot flame 41 positioned immediately adjacent the burner 40 is used to ignite it.

Surrounding the combustion chamber (or chambers) 20 is a heat exchanger 30 with its interior boundary being formed by the exterior walls 36 of the combustion chamber 20 and its exterior boundary being formed by the walls 35. Thus two separate fluid paths are formed. The combustion chamber path leads from the gas outlet 24 and air inlets 22 through the burner 40 and out the flue 25. The heat exchanger path follows the exterior walls 36 of the combustion chamber 20, with the fluid to be heated entering below the burner 40, proceeding along the vertical portion of the enclosed area between the walls 35 and the exterior burner wall 36 to exit above the combustion chamber 20. While in the preferred embodiment air is the fluid to be heated, other fluids, such as water, may also be used with minor design changes.

As is conventional, movement of air into and through the heat exchanger 30 is provided by a fan or blower 34 driven by an electric motor 38 (not shown in FIG. 1). Cold air is pulled into the heat exchanger 30 at a cold air return duct 32 and passes through an air filter 33 before it enters the fan 34. The fan 34 drives the air into the heat exchanger 30 through an opening in its bottom wall. Heated air passes out of the heat exchanger 30 through a warm air duct 37, which extends from an opening in the top wall of the heat exchanger 30.

With the exception of the flue 25 and the combustion air inlets 22 adjacent the gas outlet 24, the combustion chamber 20 is enclosed and substantially air-tight. Accordingly, the only exit for combustion materials is provided by the flue 25. In order to induce air to enter the combustion chamber 20 at the combustion air inlets 22 and to induce combusted gases to exit from the combustion chamber 20 and flow out the flue 25 and exhaust stack or vent 80, an induced draft blower 60 is used. This induced draft blower 60, with its electric motor 61 and fan blades 62, is located in line with the flue 25 and the exhaust stack or vent 80. Electric power is supplied to the motor 61 by a line voltage source, indicated by wires 13. The blower 60 has at least two speeds, depending on the type of control system with which it is to be used. While blowers of various specifications may be used, in the preferred embodiment the blower 60 is two-speed and is powered by 120 volts a.c. At high speed, it produces 1 inch W.C. minimum pressure (relative to atmosphere) at 450 degrees Fahrenheit, at a flow rate of about 50 c.f.m. At low speed, it delivers approximately 25 c.f.m.

The fluid fuel is provided to the burner 40 at the gas outlet 24, fed by the outlet pipe 104 of a modulating gas valve or means for changing the fuel supply 100, which serves as a primary element of a fuel supply control means. Gas from a supply maintained at line pressure enters the gas valve 100 at a gas inlet pipe 101. Gas regulated to the desired outlet pressure flows out of the gas valve 100 through the outlet pipe 104. The pilot flame 41 is supplied with gas at line pressure by a smaller outlet pipe 102. The detailed structure and operation of the gas valve 100 which permits it to regulate gas to the desired pressure is described below.

FIG. 1 also shows in a general, schematic manner, the interconnections between the various components forming the furnace control system. Coordination of the control system is provided by a thermostatic control 200 which includes various temperature-sensitive components and switching elements, as will be described in greater detail below in connection with FIGS. 4 and 5. These components and switching elements serve as the means for controlling operation of the blower 60 and for enabling the gas valve 100. Power to the thermostatic control 200 is provided by connections to a line voltage source, indicated by wires 201, 202.

Figure 2A:
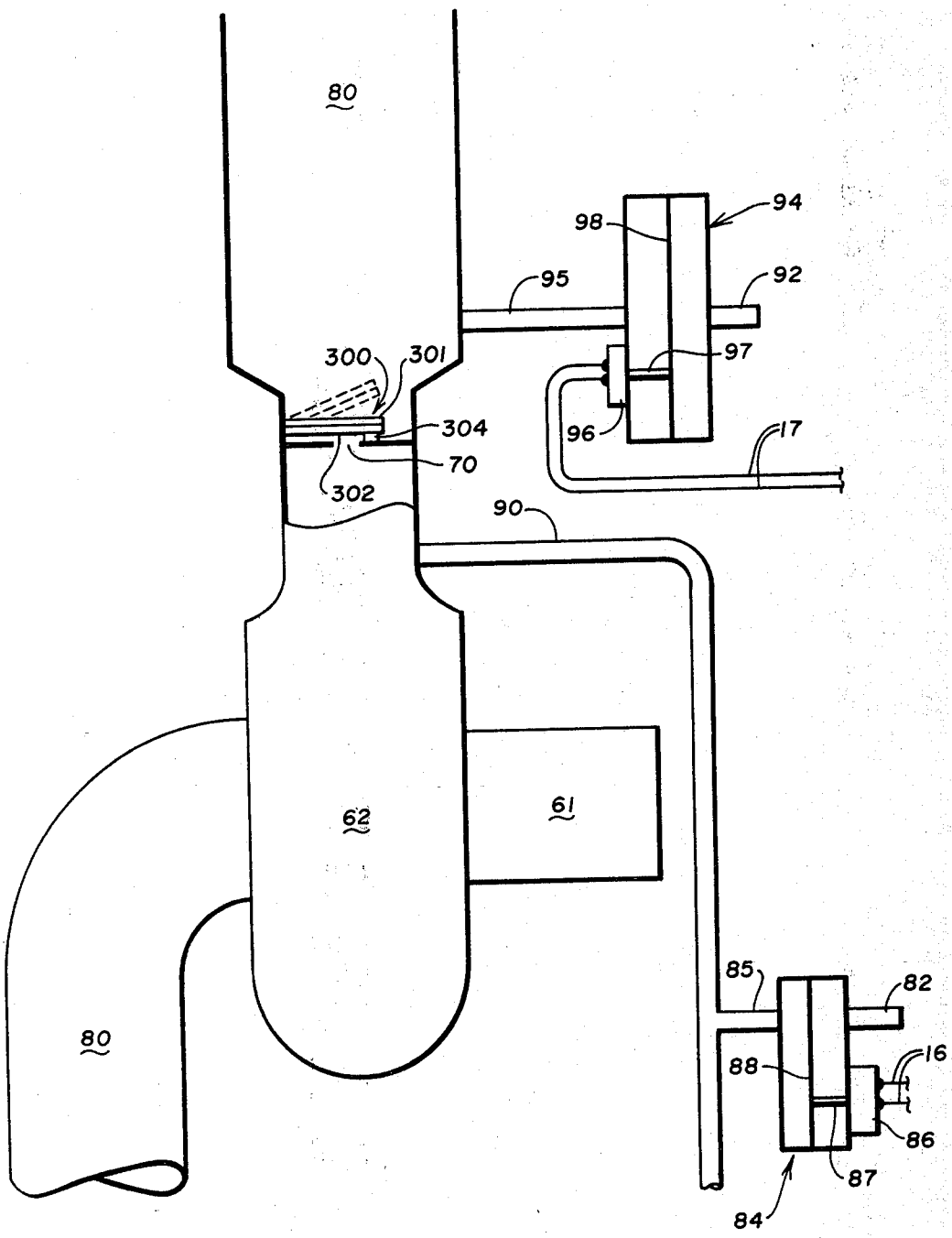

The thermostatic control 200 is electrically connected, via wires 16, to a first differential pressure switch 86, which is actuated by a differential pressure sensor 84. Referring now also to FIG. 2*a*, one input to the differential pressure sensor 84 is provided by a conduit 85 which connects one side of the differential pressure sensor 84 to a conduit 90 which, in turn, is connected to the gas valve 100 and to a pressure region in the exhaust stack 80. In the embodiment shown in FIG. 1, this region is located downstream from the induced draft blower 60 and upstream from a flow-limiting restriction, preferably a stack orifice 70, which is also located downstream of the blower 60. The pressure in this region near the orifice 70 will hereinafter be referred to as the "feedback pressure." The second input to the differential pressure sensor 84 is provided by a conduit 82 which communicates with the other side of the differential pressure sensor 84. The pressure in conduit 82 is derived from the furnace system's ambient atmosphere. This pressure will hereinafter be referred to as the "atmospheric reference pressure." Referring again to FIG. 2*a*, as is conventional in such pressure sensors, the pressure differential, which corresponds to volume flow in the exhaust stack 80, affects the position of a diaphragm 88 which, in turn, through an actuator rod 87, causes the switch 86 to change state when a predetermined pressure differential (e.g., 0.85 inches W.C.) exists. This change of state in the switch 86 causes one circuit path to be opened while another is simultaneously closed. (Due to inherent hysteresis, the switch 86 will actually change state at two somewhat different predetermined values, depending on whether the pressure differential is increasing or decreasing.)

Referring again to FIG. 1, a feedback conduit 90 which is connected to and through the wall of the stack 80 communicates a stack or exhaust gas pressure sensed at the point of connection back to the modulating gas valve 100. As is described below, this pressure feedback signal, communicated via the conduit 90, is used to modulate the outlet gas pressure and, thus, the fuel flow rate, from the valve 100.

The thermostatic control 200 is also electrically connected to the motor 61 of the stack blower 60 via wires 13. As is described in greater detail below, it is this connection which permits the thermostatic control 200 to turn the blower motor 61 on and off and to switch the blower 60 between a first speed and a second speed.

The thermostatic control 200 is further electrically connected to the gas valve 100, via wires 15. It is this connection which permits the thermostatic control 200 to ensure that gas is available from the gas valve 100 to the gas outlet pipe 104 and the pilot outlet pipe 102 only when desired.

Figure 2B:
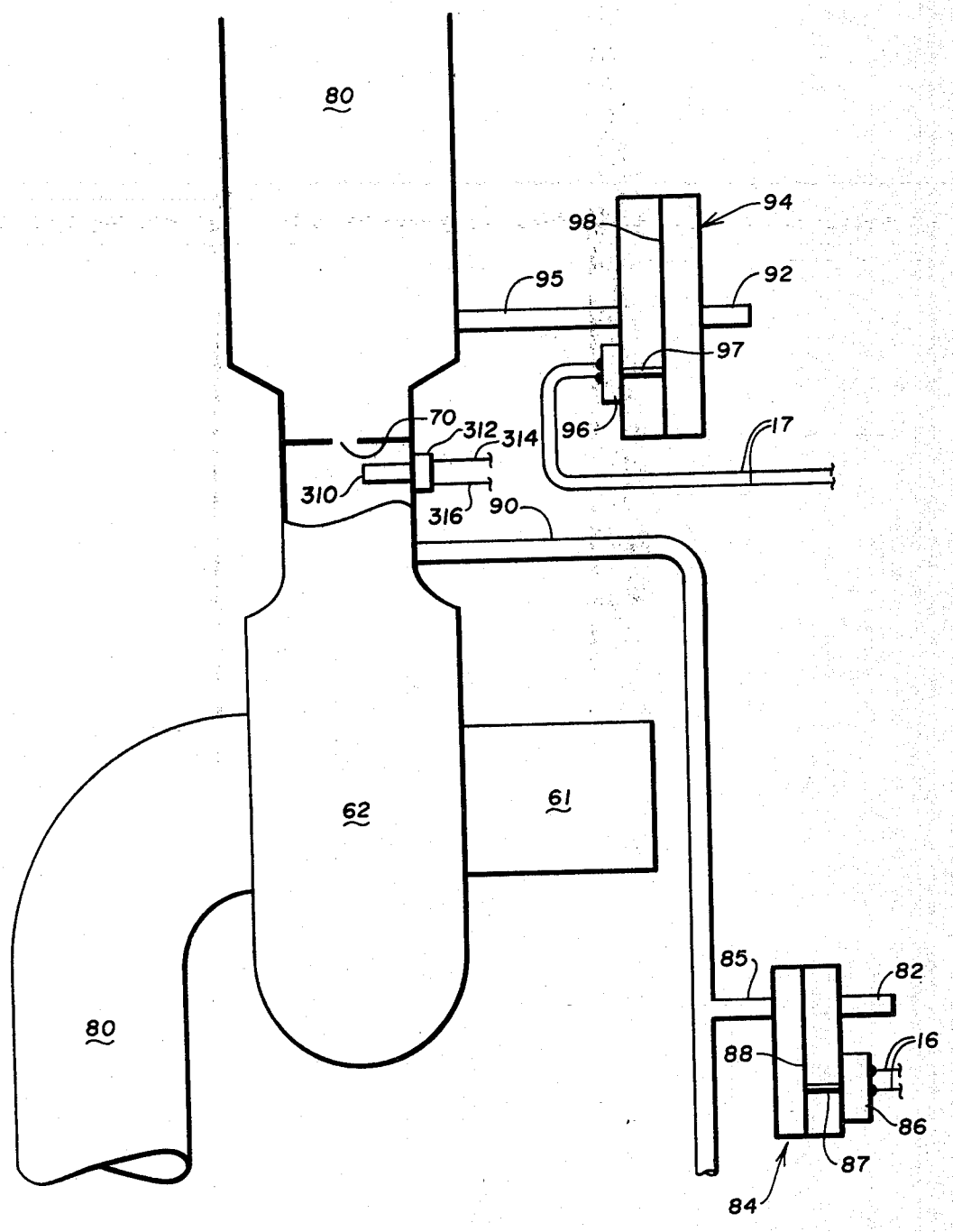

A still further electrical connection to the thermostatic control 200 comes from a second differential pressure sensor 94, via wires 17. As seen in FIGS. 1, 2*a* and 2*b*, one input to the second differential pressure sensor 94 is provided by a conduit 95 which connects one side of the differential pressure sensor 94 to a pressure region in the exhaust stack 80 downstream from both the blower 60 and the orifice 70. The pressure in this region will hereinafter be referred to as the "stack exit pressure." The second input to the second differential pressure sensor 94 is atmospheric reference pressure via the conduit 92. As in the first differential sensor 84, the second sensor 94 has a diaphragm 98 which actuates a rod 97 to trip a switch 96, electrically connected to the thermostatic control 200. The function of this arrangement, as explained in greater detail below, is to detect dangerous blocked stack conditions, which are characterized by elevated stack exit pressures.

The fan 34 which circulates air through the heat exchanger 30 is provided with power by line voltage connections 11 and 12. The fan motor 38 (FIGS. 4,5; not shown in FIG. 1) is electrically connected, via wires 18, to a fan limit control switch 56 which is driven by a temperature sensitive element 57, such as a bimetal thermostat. This temperature sensitive element 57 causes the fan motor 38 to be switched on when the air temperature in the heat exchanger 30 rises above a predetermined temperature (fan-start setpoint) and to be switched off when the temperature of the air in the heat exchanger 30 sinks below a predetermined temperature (fan-stop setpoint). One suitable temperature sensitive switch for this purpose is the L4064 fan and limit switch manufactured by Honeywell Inc., of Minneapolis, Minn. Because one purpose of the fan limit control switch 56 is to delay fan start-up until the heat exchanger 30 contains air at or above a predetermined temperature, a time-delay mechanism could be substituted for the temperature sensitive element 57. This mechanism could be activated at the same time as the blower motor 61, but it would delay fan start-up for a predetermined period sufficient to let the heat exchanger 30 reach the predetermined temperature.

b. Modulating Gas Valve

Figure 3A:
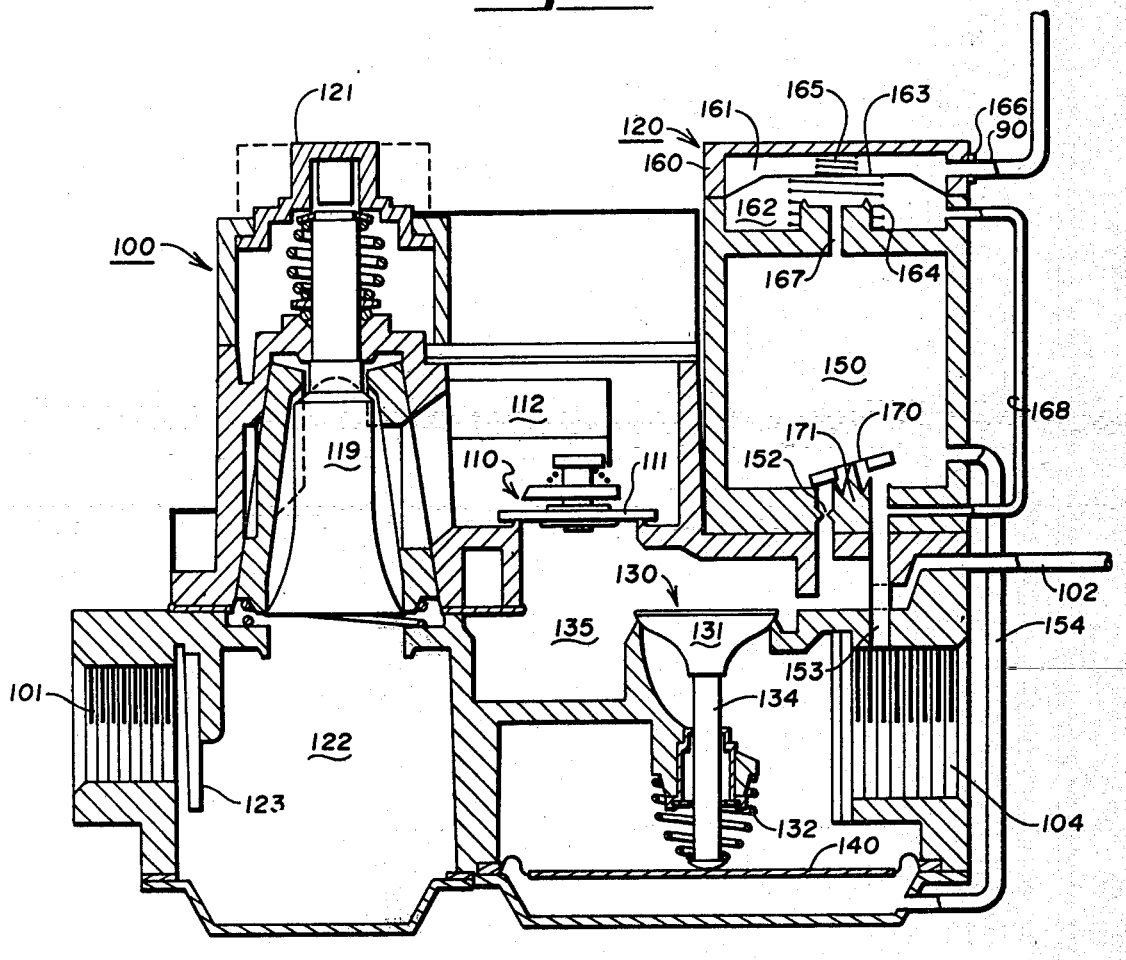
Figure 3B:
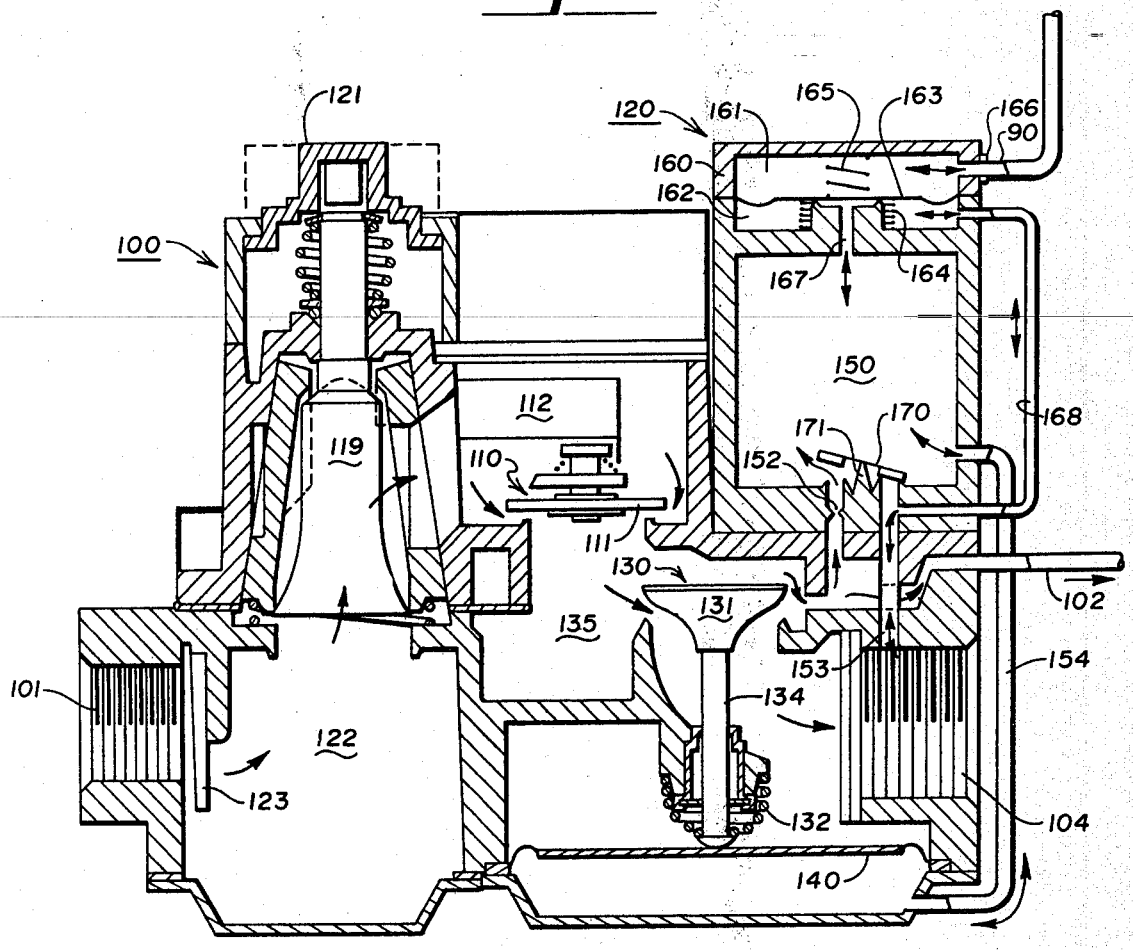

Schematically shown in FIGS. 3*a* and 3*b*, is the detailed structure of the preferred embodiment of the pressure modulating gas valve 100, including its connections to various other parts of the furnace system. In the preferred embodiment, this valve is a redundant, modulating gas valve, such as the Model VR 860 valve manufactured by Honeywell Inc. with its conventional configuration adapted to receive a feedback pressure signal in the upper portion of its servo pressure regulator chamber. Referring now to FIG. 3*a*, which shows the gas valve 100 in the "off" position, it is seen that the fuel gas supply (at line pressure, typically 7 to 10 inches W.C.) enters the valve 100 via a gas inlet pipe 101, while the pressure-regulated outlet gas leaves the valve to flow to the burner 40 through the outlet pipe 104. The gas valve 100 is made up of several components. These can generally be divided into a first main valve 110, a second main valve 130 and a regulator valve section 120. The first main valve 110 opens and closes by means of a valve disc 111 which is actuated by a solenoid mechanism 112. When this first main valve 110 is open (FIG. 3*b*), gas is permitted to flow into the region above the second main valve 130 and also to the pilot outlet pipe 102.

The gas valve 100 has an inlet chamber 122, which is located below a manually-actuated on-off valve 119 controlled by the knob 121. Gas can enter the inlet chamber 122 by flowing under the dirt barrier 123 and upwards toward the first main valve 110. After passing the first main valve 110, the gas will enter the second main valve chamber 135, which contains a second main valve disc 131 mounted via a stem 134 on a second main valve spring 132, which biases the second main valve 130 into a closed position. The lower end of the stem 134 of the main valve disc 131 bears against a main valve diaphragm 140.

The regulator valve section 120 comprises an operator valve chamber 150 which accomodates a seesaw-like operator valve 170 actuated by a suitable electromagnetic actuator 171. Located above the operator valve chamber 150 is a servo pressure regulator chamber 160, divided into an upper portion 161 and a lower portion 162 by a regulator diaphragm 163. The regulator diaphragm 163 is balanced by opposing springs. The lower spring 164 exerts an upward force, and the upper spring 165 exerts a downward force, as viewed in FIGS. 3*a* and 3*b*.

Other important structural features of the regulator valve section 120 include a working gas supply orifice 152 in a conduit communicating between the operator valve chamber 150 and the chamber 135 above the second main valve 130. The feedback pressure conduit 90 is connected to the upper portion 161 of the regulator chamber 160 by means of a feedback connector fitting 166. Accordingly, the pressure in the upper portion 161 of the regulator chamber 160 will be the pressure sensed in the stack 80 and communicated back to the gas valve 100 by the conduit 90. The gas valve 100, together with the conduit 90 and the stack orifice 70, comprise a variable fuel supply control means.

c. Control System

Shown in FIG. 4 is an electrical schematic of the thermostatic control 200 associated with the present invention. This schematic illustrates the components which would be contained within the thermostatic control 200 and also those electrically connected thereto, such as the electric motors 38, 61, the fan control switch 56 and the differential pressure switches 86, 96. The thermostatic control 200 has two stages, with two thermostat elements 250, 251 (such as in Honeywell Inc. thermostat model T872F). Line voltage power is provided on wires 201 and 202. This line voltage is used to power the fan motor 38, to which it is connected via the wires 11, 12, 18 and the normally open main contacts 58 of the fan limit control switch 56. In an electrical path parallel to the fan motor 38 are the coil for the R3 relay 280 and a normally closed pair of contacts 271 actuated by the R2 relay 270. Also powered by the line voltage, via the three wires 13, is a two-speed draft blower motor 61. The parameters of the blower 60, including its effective flow rates at higher and lower speeds, are chosen so that the furnace will operate at substantially its design maximum when the blower motor 61 is on its higher speed. The lower speed of the blower motor 61 is chosen to produce a firing rate less than the design maximum for the furnace. Typically, the lower firing rate will be on the order of 50% to 70% of the design maximum.

Normally open relay contacts 261 actuated by R4 relay 260 are in series with the blower motor 61. The high speed circuit to the blower 61 is controlled by normally closed contacts 281 actuated by R3 relay 280, while the low speed circuit for the blower 61 is controlled by normally open contacts 282, also actuated by R3 relay 280. The contacts 282 close when the contacts 281 open, and vice versa. Voltage at an appropriate level for the room thermostat portion of the control, in the preferred embodiment 24 volts a.c., is provided by the secondary of the transformer 210, which is powered on its primary side by line voltage.

As seen in FIG. 4, there are two different temperature-actuated circuits in parallel with the secondary side of the transformer 210. The first circuit includes a bimetal-mercury thermostat element 250 with contacts 250*a*. Contacts 86*a* and 86*b*, activated by the differential pressure switch 86, are connected in series with the coil of the R4 blower control relay 260 and with the solenoid actuator 112, respectively. Contacts 261, 262 and 263 are driven by the R4 relay 260.

Switch contacts 86*a* (normally closed) in series with the coil of the R4 relay 260, and switch contacts 86*b* (normally open), in series with the solenoid actuator 112 for the first main valve 110 (FIG. 3*a*), are actuated by the differential pressure switch 86. This switch is constructed such that when the contacts 86*a* open, contacts 86*b* close, while when contacts 86*b* close, contacts 86*a* open. The solenoid actuator 112 for the first main valve 110 is also connected in series with relay contacts 263. This configuration constitutes a safe start feature (as further explained below), because each startup cycle requires that the differential pressure switch 86 go from its normal state (contacts 86*a* closed, contacts 86*b* open) to its switched state (contacts 86*a* open, contacts 86*b* closed). Should, for example, the contacts 86*a* be welded closed, the R4 relay 260 will be activated, but the actuator 112 will receive no current, because the contacts 86*b* will be kept open.

In the second temperature-actuated circuit connected in parallel to the secondary side of transformer 210 is a second bimetal-mercury thermostat element 251 with contacts 251*a*, which is connected in series with the coil for R2 relay 270, driving the normally-closed contacts 271. The bimetal element 251 is set to close its contacts at a slightly lower temperature (e.g. 2–3 degrees Fahrenheit) than the actuation temperature for the other bimetal element 250. As will be described in greater detail below, the function of this second temperature-actuated circuit is to switch the blower motor 61 between its higher and lower speeds under certain circumstances, by controlling the power to the coil of the R3 relay 280.

Additional elements of the control system are normally closed contacts 59, in series with the primary side of the transformer 210, and normally closed contacts 96*a*, in series with the secondary side of the transformer 210. Contacts 59 are opened by fan limit control switch 56 at a predetermined temperature (shutdown setpoint), corresponding to a dangerously high heat exchanger temperature. Contacts 96*a* are opened by the switch 96 when the differential pressure sensor 94 detects a high stack exit pressure, indicating a blocked stack.

d. Exhaust Gas Density Compensation

The means for compensating for changes in exhaust gas density at higher and lower firing rates are shown in FIGS. 2*a*, 2*b*, 5, 6*a* and 6*b*. Exhaust gas temperature, which is related to firing rate, is one parameter affecting exhaust gas density and, when other parameters are constant, exhaust gas temperature is indicative of density. Shown in FIG. 2*a* is one of the two embodiments herein disclosed. As seen in FIG. 2*a*, a bimetal strip 300 is located in the exhaust stack 80 just downstream from the flow-limiting orifice 70. The bimetal strip or temperature responsive element 300 is made up of two substantially planar strips 301, 302 of dissimilar metals, which have been joined and oriented substantially parallel to the plane of the orifice 70 to form an element which deflects away from the orifice 70 (as shown in dotted lines in FIG. 2*a*) when exposed to the higher exhaust gas temperatures of the furnace's higher firing rate. When the strip 300 is exposed to ambient temperatures or the lower exhaust gas temperatures of the lower firing rate, is rests against a stop 304, which may be connected to the orifice 70. This stop 304 prevents the strip 300 from completely blocking the orifice 70. However, when the strip 300 rests against the stop 304, it significantly limits the flow of exhaust gas. Thus, the stop 304 determines a minimum effective orifice size which will exist when the furnace is off or operating at a low firing rate. At higher firing rates, the strip 300 bends away from the orifice 70 to produce a greater effective orifice size.

Figure 6A:
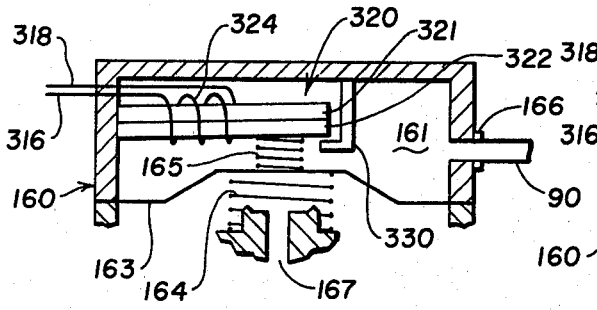
Figure 6B:
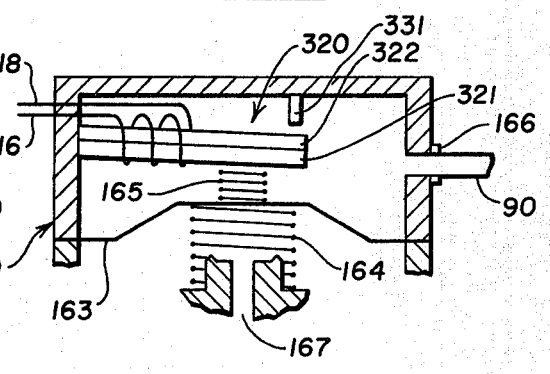

Because placement of a moving part such as the strip 300 in the harsh environment of the exhaust stack 80 may make cleaning or maintenance of the part necessary, an alternative means of compensating for changes in exhaust gas density is proposed. As shown in FIGS. 2*b*, 6*a* and 6*b*, this alternative means includes: a thermal-sensitive resistance element or temperature responsive means 312 which is connected to the exhaust stack 80 and is exposed to the temperature of the exhaust gas by means of a heat conductive probe 310; a bimetal element 320, which is mounted within the upper portion 161 of the servo pressure regulator chamber 160 and which serves as the attachment point for one end of the spring 165; a resistance-type electrical heating element 324, which surrounds the bimetal element 320; and wires 314, 316 and 318, which form a series circuit from a power source (in the preferred embodiment, the secondary side of the transformer 210 provides power), through the temperature-sensitive resistance element 312 and the heating element 324 back to the power source. With this configuration, changes in the resistance of the resistance element 312 cause the current and power available to the heating element 324 to change, which, in turn, causes the bimetal element 320 to deflect to varying degrees, thereby causing the balance of spring forces on the servoregulator diaphragm 163 to change, as the spring 165 is extended or shortened.

When the thermal-sensitive resistance element 312 is a positive temperature coefficient (PTC) sensor, the bimetal element 320 is constructed and oriented such that when heated it deflects toward the servoregulator diaphragm 163 up to a limit determined by a stop 330. When the thermal-sensitive resistance element 312 is a negative temperature coefficient (NTC) sensor, the bimetal element 320 is given an opposite orientation, such that it deflects away from the diaphragm 163 up to a limit determined by a stop 331. The PTC sensor causes significant deflection of the bimetal element 320 when the furnace is operating at lower firing rates, while the NTC sensor causes significant deflection when the furnace is operating at higher firing rates.

As shown in FIG. 5, the circuit comprising wires 314, 316 and 318, the resistance element 312 and the heating element 324 can be connected to the secondary side of the transformer 210 in two different ways to modify the basic circuit shown in FIG. 4. In one variation, the connection is parallel to the power source, the transformer secondary. This is accomplished by connecting the wire 314 to the circuit point 315 and by connecting the wire 318 to the circuit point 313. In the second variation, the circuit is connected in series with the power source. This is accomplished by replacing the direct connection between circuit points 317 and 319 with the circuit comprising wires 314, 316 and 318, the resistance element 312 and the heating element 324.

Operation of Preferred and Alternate Embodiments

The operation of the present invention can best be understood in terms of three interrelated sequences of operation. The first sequence of operation concerns the functioning of the modulating gas supply valve 100. This valve is designed to produce an outlet gas pressure which is modulated in accordance with the magnitude of a pressure signal sensed on one side of the stack orifice 70. In particular, the valve 100 is intended to produce an outlet gas pressure which is linearly proportional to the magnitude of the pressure sensed in the region of the stack 80 near the blower 60 and stack orifice 70. As shown in FIGS. 1, 2*a*, 2*b*, 3*a* and 3*b*, this pressure is sensed and fed back to the gas valve 100 by means of a conduit 90, which at one end is connected to and through the wall of the exhaust stack 80 just upstream from the stack orifice 70. At its other end, the conduit 90 communicates with a fitting 166, which, in turn, leads into the upper portion 161 of the servo regulator chamber 160 of the gas supply valve 100.

It should be noted that although the preferred and alternate embodiments described have control systems which rely on a pressure feedback signal to control an outlet gas supply pressure, this is only one way of using a feedback signal to modulate a fuel supply rate and obtain an air-fuel ratio approximating stoichiometric combustion. The molecular ratios of fuel and oxygen desired for stoichiometric combustion are translatable into mass ratios which correspond, in the case of moving fluids in a continuous combustion process, to mass flow rates. Given the flow-restricting geometry of the gas valve 100 and the orifice 70, for a given exhaust gas temperature, the mass flow rates correspond to exhaust gas pressures measured adjacent the orifice. In particular, the greater the pressure differential across a flow-restricting orifice of a given size, the greater the mass flow through the orifice. In fact, at constant temperature, mass flow is proportional to the square root of the pressure difference. For this reason, it is possible to use the relationship between pressures sensed at appropriate locations as a substitute for direct sensing of the relationship between mass flow rates. However, it should be clear that the present invention can be implemented by sensed parameters other than pressure, which also correspond to exhaust gas flow rates, and by using the sensed values to control fuel delivery rate parameters other than gas supply pressure, although the following discussion of operation specifically discusses a pressure-oriented control system.

a. Operation of Modulating Gas Valve

As best seen in FIG. 3*a*, showing the gas supply valve 100 in the "off" position, in normal operation there are several closure points which affect the flow of gas through the gas supply valve 100. The first main valve 110 is connected via the pipe 101 and the inlet chamber 122 to the external gas supply at line pressure and can, by itself, prevent gas from flowing into the remainder of the gas supply valve 100. Accordingly, opening of the first main valve 110 is a prerequisite to any flow of gas from the outlet pipe 104. Because other closure points in the valve 100 can also independently prevent flow of outlet gas, the type of valve used in the present invention can incorporate improved safety features and is termed "redundant." Several conditions must be met before the valve 100 permits gas to flow to the burner 40.

The first main valve 110 also controls the supply of gas to the pilot outlet pipe 102. Thus, the burner 40 has an intermittent pilot. Once the first main valve 110 is open, gas can flow to the pilot 41 and also into the second main valve chamber 135.

Gas entering the gas supply valve 100 flows into the inlet chamber 122 and then flows under a dirt barrier 123, which is designed to deter foreign particles from entering the remainder of the valve. A knob 121 connected to a manually-actuated valve 119 located above the inlet chamber 122 can be used to manually open and close the flow of gas from the inlet chamber 122. This valve 119 is typically closed only in exceptional situations, not during normal operation. After passing under the dirt barrier 123 and through the first main valve 110, the gas flows into a chamber 135 located above the second main valve 130. From this chamber 135, the gas can flow to the pilot outlet pipe 102 and in one or two other directions. If the second main valve 130 is open, the gas can flow into a region above the main valve diaphragm 140 and into the outlet gas pipe 104. If the second main valve 130 is not open, the gas will tend to flow up through the working gas supply orifice 152 toward the operator valve chamber 150. This flow will be significantly restricted by the narrow orifice 152, across which there may exist a pressure gradient. However, no gas will enter the operator valve chamber 150 at all when the operator valve 170 closes the conduit which includes the orifice 152, as shown in FIG. 3*a*. Only when the operator valve 170 opens this conduit, as shown in FIG. 3*b*, can gas enter the operator valve chamber 150 from the chamber 135 and flow upward toward the servo pressure regulator chamber 160.

Gas will enter the lower portion 162 of the servo pressure regulator chamber 160 only when the regulator diaphragm 163 is not pressed down so as to sealingly engage the regulator orifice 167. When the orifice 167 is closed as shown in FIG. 3*b*, gas cannot enter the lower portion 162 of the servo pressure regulator 160, except from the outlet pipe 104, by means of the narrow conduit 168 (as discussed below). Once the orifice 167 is open, gas can flow between the operator valve chamber 150 and the lower portion 162 of the servo pressure regulator 160. Gas which enters the lower portion 162 of the servo pressure regulator chamber 160 can escape only via the conduit 168, which leads to the outlet gas pipe 104, or by flowing back into the operator valve chamber 150. It should be noted that the lower portion of the conduit 168 connects with a conduit 153, which communicates between the operator valve chamber 150 and the outlet gas pipe 104 when the operator valve 170 is in the "off" position (FIG. 3*a*). Accordingly, when the operator valve 170 is "off" as shown in FIG. 3*a*, gas can flow directly between the operator valve chamber 150 and the outlet gas pipe 104. However, when the operator valve 170 is in its "on" position, as shown in FIG. 3*b*, gas cannot flow directly between the operator valve chamber 150 and the outlet gas pipe 104. The position of the operator valve 170 does not, of course, directly limit the flow of gas between the lower portion 162 of the servo pressure regulator 160 and the outlet gas pipe 104 via the conduit 168, because it closes only one end of the conduit 153.

Gas which flows into the operator valve chamber 150 can also escape from this chamber into the conduit 154 which leads to the region below the main valve diaphragm 140. As can be seen best in FIG. 3*b*, gas pressure in the region below the main valve diaphragm 140 presses upward on the main valve diaphragm 40 against the force of the second main valve spring 132 to raise the second main valve disc 131. Because the surface area of the diaphragm 140 is relatively large, gas pressure in the region below the diaphragm 140 has a mechanical advantage as against the gas pressure in the chamber 135 when the second main valve 130, with its disc 131 of smaller surface area, is closed.

To regulate the outlet gas pressure to be proportional to the pressure which is communicated via the conduit 90 to the upper portion 161 of the servo pressure regulator 160, the various valve components function as follows, as shown in FIGS. 1, 2*a*, 2*b*, 3*a* and 3*b*. Assuming that the burner 40 has been off for at least a short period of time and the first main valve 110 and the operator valve 170 have been closed, the various closure points will be as shown in FIG. 3*a*. This is because any excess (greater than atmospheric) pressure will have been dissipated from the outlet gas pipe 104 and thus from the area below the second main valve 130 and below the regulator diaphragm 163. Further, because the operator valve 170 has been in its "off" position, excess pressure in the operator valve chamber 150 and below the main valve diaphragm 140 will also have been dissipated. The same atmospheric pressure will thus exist above and below the main valve diaphragm 140, in the valve operator chamber 150 and in the region 162 below the regulator diaphragm 163. Accordingly, the second main valve 130 will be forced to its closed position by the spring 132 and by any excess pressure which may remain in the chamber 135.

Because the stack blower 60 has been off, the feedback conduit 90 and the region 161 above the regulator diaphragm 163 also contain atmospheric pressure and the regulator diaphragm 163 assumes its rest position, as determined by the balance of forces between the springs 164 and 165. The regulator diaphragm 163 is pushed away from the regulator orifice 167, because the spring 164 is selected (or adjusted by suitable screw adjustment means, not shown) such that the pressure in the upper portion 161 must exceed the pressure in the lower portion 162 by a given threshold pressure (0.2 inches W.C. in the preferred embodiment), before the regulator diaphragm 163 will close against the regulator orifice 167.

Assuming that the preceding conditions obtain, once the first main valve 110 permits gas to enter the chamber 135 above the closed second main valve 130, the gas can go no further (except to the pilot outlet pipe 102) until the operator valve 170 is opened. This will occur when its actuator 171 has been activated as a result of proof of pilot flame. (This can be done by a conventional ionized gas circuit as part of the intermittent pilot system and is not explained in further detail herein.) Upon opening of the operator valve 170, gas at line pressure flows through the orifice 152 into the operator valve chamber 150 and into the lower portion 162 of the regulator chamber 160. A small amount of gas will begin to flow into the outlet pipe 104 through the conduit 168. Gas also flows into the conduit 154 leading to the region under the main valve diaphragm 140. Pressure will begin to build in this region, tending to push the main valve diaphragm 140 upward. This gas pressure will, however, not significantly exceed the forces holding the second main valve 130 closed, because of the force of the spring 132, the high line pressure of the gas in the chamber 135 and the gas flow from the operator valve chamber 150 into the lower portion 162 of the regulator chamber 160 and out through the conduit 168.

Assuming that the blower 60 has been switched on (as explained below), as the speed of the blower 60 reaches its maximum, a feedback pressure will begin to build up upstream from the orifice 70 and be fed back to the upper portion 161 of the regulator chamber 160 via the conduit 90. When this feedback pressure exceeds the pressure below the regulator diaphragm 163 by a predetermined threshold value $P_t$, in the preferred embodiment 0.2 inches W.C., regulator orifice 167 will be closed by the diaphragm 163. The requirement of an excess pressure of 0.2 inches W.C. serves to prove blower operation. When the orifice 167 closes, this will cut off gas flow to the conduit 168, cause an increase in the pressure in the operator chamber 150, and cause the pressure below the main valve diaphragm 140 to increase. The main valve diaphragm 140 will be pushed upward, eventually forcing the second main valve 130 to open (FIG. 3*b*). This, in turn, will cause the pressure in the outlet pipe 104, to rise, which pressure is communicated up to the lower portion 162 of the regulator chamber 160 via the conduits 153 and 168. This rising pressure in the lower portion 162 of the regulator chamber 160 will eventually overcome the feedback pressure in the upper portion 161, to reopen the regulator orifice 167. This, in turn, causes the pressures in the operator valve chamber 150 and the area below the main valve diaphragm 140 to tend to decrease, which causes the second main valve 130 to tend to close and the outlet gas pressure and the pressure below the regulator diaphragm 163 to decrease. Because the lower spring 164 overcomes the upper spring 165 when the pressure below the regulator diaphragm 163 rises to within 0.2 inches W.C. of the pressure above the regulator diaphragm 163, while the spring 165 overcomes the spring 164 when the feedback pressure exceeds the pressure below the diaphragm 163 by more than 0.2 inches W.C., the outlet gas pressure ($P_o$), in the absence of any compensation for changes in exhaust gas density, would be regulated to be substantially equal to the feedback pressure ($P_f$), less 0.2 inches W.C. (the threshold pressure $P_t$). Thus, $P_o = P_f - 0.2 = P_f - P_t$, where all pressures are expressed in inches W.C. and are relative to atmospheric pressure.

A furnace with a modulating gas valve and feedback arrangement which regulates the supply of fuel in accordance with the preceding equation, will have less excess air at lower firing rates than a furnace in which derating is accomplished by merely decreasing the rate of supply of fuel without any change in draft flow. Nonetheless, as noted previously, the decreased temperature and increased density of the exhaust gas when the furnace is operated at a low firing rate, result in excess air even with a modulating gas valve and feedback arrangement. Accordingly, as described in greater detail below, steps are taken to modify the basic relationship stated by the equation $P_o = P_f - 0.2 = P_f - P_t$, such that $P_o$, which corresponds to the rate of supply of fuel, is increased, relative to the supply of combustion air, for lower firing rates.

b. Operation of Thermostat Control Systems

Referring now to FIG. 4, the second important sequence of operation, the operation of the electrical components for the two-stage thermostat control system, which provides a high and low firing rate, is described.

When the temperature of the heated space sinks below the setpoint of the thermostat element 250 with the higher setpoint, the contacts **250*a* close and the coil of R4 relay 260 is activated via normally closed contacts 86*a*, thereby causing the contacts 261, 262 and 263 to close. Because the R3 relay 280 is not active at this point (the main contacts 58 of fan limit control switch 56 are open), the R3 relay contacts 281 are closed and the two-speed blower motor 61 comes on at high speed, corresponding to the higher firing rate of the furnace. Pressure begins to build in the stack 80 upstream from the orifice 70. When the upstream pressure exceeds the atmospheric reference pressure by a predetermined amount, the differential pressure switch 86 changes state, closing contacts 86*b* and opening contacts 86*a*, to activate the solenoid 112 of the first main valve 110. Thus, the previously described operations sequence for the gas valve 100 commences. The pilot flame 41 gets gas and is ignited. The regulator valve section 120** begins to regulate the outlet gas pressure to be proportional to the feedback pressure ($P_o = P_f - 0.2$), as previously described.

As the burner 40 lights and the temperature in the combustion chamber 20 and the heat exchanger 30 rises, this is sensed by the temperature sensor 57 (FIG. 1) of the fan limit control switch 56. When the fan-start setpoint for this sensor is reached, the fan motor 38 is energized via the now closed contacts 58. This also energizes the R3 relay 280, causing contacts 281 to open and contacts 282 to close. This switches the blower motor 61 to low speed, corresponding to the lower or derated firing rate, in the preferred embodiment, 50% to 70% of the higher firing rate, and the burning phase continues. When the temperature in the heated space rises to the setpoint of the thermostat element 250, its contacts open and the blower motor 61 and the solenoid 112 are both deenergized. Shutdown of the fan motor 38 follows later, when the bimetal sensor 57 of the fan limit control switch 56 reaches its fan-stop setpoint, causing the main contacts 58 to open.

Should the temperature in the heated space at any time drop below the setpoint of the thermostat element 251, then the contacts 251*a* will close and the R2 relay 270 will be activated. If this occurs when the R3 relay 280 is activated (contacts 282 closed; lower firing rate), it will cause the R3 relay to be deactivated (contacts 281 closed; higher firing rate). That is, if the blower motor 61 is operating at low speed, activation of thermostat element 251 will switch it to high speed. If the R2 relay 270 is activated when the R3 relay 280 is not activated, no change in blower speed will occur. If a burning phase begins with both thermostat elements 250, 251 activated, then the R2 relay 270 will be activated and the system will not switch to the lower firing rate when the fan motor 38 is turned on. Only when the thermostat element 251 with the lower setpoint is satisfied, will the system be able to switch to the lower firing rate.

In cases where the furnace is substantially derated at the lower blower speed, a slight modification of the differential pressure sensor 84 may be required for proper operation of a two-stage thermostatic control system. If the lower blower speed results in a decrease in the feedback pressure such that the pressure differential required to trip switch 86 is not achieved, then the sensor 84 must be modified by decreasing the required pressure differential to a lower value, e.g. 0.25 inches W.C., to avoid burner shutdown when the blower motor 61 switches to its lower speed.

As controlled by a two-stage thermostatic control system, the present invention operates with a two-speed induced draft blower and feedback controlled fuel-gas pressure to produce a furnace with a higher and a lower firing rate. Off-cycle losses are reduced by the presence of the blower 60 and the orifice 70 in the stack 80 which allow significant draft flow, with its consequent heat loss, only during the burning phase. In addition, substantial derating can be achieved for a significant portion of the burning phase because the system switches to a lower firing rate after start-up. However, because the system always starts at the higher firing rate and maintains this rate until the heat exchanger 30 reaches a predetermined temperature (usually selected at or somewhat above the dewpoint), there is no substantial increase in condensation, which might decrease furnace life. In addition, the two-stage control system permits the furnace to stay at the higher firing rate when necessary to achieve desired temperatures under heavy heating load or to speed recovery from a period of temperature setback, such as at night. To reduce the excess air condition which may arise when the furnace operates at lower firing rates the present invention also contemplates means for compensating for changes in exhaust gas density, as described next.

c. Operation of Density Compensating Components

The third important sequence of operation for the present invention concerns the mechanisms for compensating for changes in exhaust gas density. The basic purpose of this sequence of operation is to modify the rate of supply of fuel as determined by the two previously-described sequences of operation, such that the excess air condition which is encountered at lower firing rates is lessened or eliminated. This permits the furnace to remain closer to the ideal condition of stoichiometric burning, whether it is operated at a high or a low firing rate.

Referring now to FIGS. 1, 2*a*, and 4, operation of one embodiment of the exhaust gas density compensating feature of the present invention can be described. In this embodiment a bimetal strip 300 is located in the exhaust stack 80 adjacent to orifice 70 and is used to vary the effective orifice size which, in turn, affects the pressure head which is built up upstream from the orifice 70. Thus, the strip 300, together with the orifice 70 form a variable flow restriction subsystem which changes the degree of flow restriction on the exhaust gas in accordance with changes in exhaust gas temperature and, thereby, varies the feedback pressure produced at a given volume flow rate of exhaust gas. Because the density of the exhaust gas is related to its temperature and because the feedback pressure is used to determine the rate of fuel supply from the valve 100, the subsystem can perform the desired density compensation function, by changing the rate of fuel supply relative to the rate at which combustion air is entering.

Referring now to FIG. 2*a*, when the gas in the exhaust stack 80 is at ambient temperature (i.e., the furnace has been off for a period of time) the strip 300 rests against the stop 304. When the furnace is operating at low firing rate, the exhaust gas temperature is still not high enough to cause the strip 300 to bend away from the stop 304. Accordingly, when the furnace is off or at low firing rate the effective orifice size is at a minimum and the feedback pressure for any given exhaust gas flow rate will be at a maximum.

As the firing rate is increased, the exhaust gas temperature increases and the density of the exhaust gas decreases. The increased temperature causes the strip 300 to bend away from its stop 304 and from the orifice 70, decreasing the degree of flow restriction and the exhaust gas pressure built up behind the orifice 70. As a result, the feedback pressure decreases and the rate of fuel supply from the valve 100 is decreased in accordance with the previously stated equation $P_o = P_f - P_t$. The principal effect of the strip 300 moving away from the orifice 70 is to increase the inflow of combustion air. Of secondary importance is the decrease in exhaust gas and feedback pressure. In effect, the bimetal strip 300 and stop 304 make $P_f$ a function of exhaust gas temperature, with the value of $P_f$ being lower for higher exhaust gas temperatures. By choosing the proper size and shape of the strip 300 relative to the size of the orifice 70 and the deflection characteristics of the strip 300 at exhaust gas temperatures corresponding to the high firing rate, it is possible to calibrate the furnace to have a low level of excess air for high firing rates. Then, to prevent the increase in exhaust gas density at lower firing rates from causing high excess air burning conditions, the bimetal strip 300 moves back toward the stop 304 to modify the feedback pressure and, thus, the rate of fuel supply, increasing both for lower firing rates.

An alternative arrangement for compensating for changes in exhaust gas density is shown in FIGS. 2*b*, 5, 6*a* and 6*b*. Whereas in the density compensation mechanism previously described in connection with FIG. 2*a* the magnitude of the feedback signal for a given exhaust gas volume flow was increased, in this arrangement the magnitude of the feedback signal remains the same, but the valve 100 is modified so that at lower firing rates a given feedback pressure produces a higher gas outlet pressure than the same pressure at a higher firing rate.

In the alternative arrangement shown in FIGS. 2*b*, 5, 6*a* and 6*b*, the temperature of the exhaust gas in the stack 80 is sensed by a probe 310 which conducts the temperature to a temperature sensitive resistance element 312, preferably a positive temperature coefficient (PTC) sensor, for example, the Model C773 manufactured by Honeywell Inc. With this type of sensor, the resistance element has low resistance values at low temperatures and higher resistance values at higher temperatures, within its operating temperature range. The highest resistance value is several times larger than the lowest value.

The resistance type electrical heating element 324 which is series-connected with the resistance element 312 has a resistance value which is at least a factor of ten less than the lowest resistance of the sensor. Accordingly, given a sufficient power source, such as the secondary voltage of the transformer 210, which can supply a stable voltage over a range of currents, increases in exhaust gas temperature and in the resistance of element 312 will lower the heating current delivered to the heating element 324. Correspondingly, decreases in the exhaust gas temperature and in the resistance of element 312 will increase the heating current delivered to the heating element 324.

Referring now to FIG. 6*a*, the bimetal element 320, around which the heating element 324 is attached, is constructed and oriented so that it bends toward the diaphragm 163 when it is heated. This changes the balance between the spring forces of springs 164 and 165 acting on the diaphragm 163 in such a way that the effect of the feedback pressure in the upper portion 161 of the servo regulator chamber 160 is augmented Because the PTC sensor has lower resistance at lower exhaust gas temperatures, the greatest heating of the bimetal element 320 occurs at low firing rates and exhaust gas temperatures. This leads to a higher outlet gas pressure when the exhaust gas temperature is lower and the exhaust gas density higher. The relative increase in the rate of fuel supply at lower firing rates counteracts the undesirable tendency towards an excess air condition at lower firing rates. With the PTC sensor, the system is constructed and calibrated such that the unheated (or slightly heated) and undeflected bimetal element 320 balances the springs 164, 165 so as to provide a low level of excess air at high exhaust gas temperatures.

Referring now to FIG. 6*b*, the bimetal element 320 has a reversed orientation as compared to FIG. 6*a*. In particular, the bimetal element 320 is oriented so that it bends away from the diaphragm 163 when it is heated. Again, this changes the balance between the spring forces of springs 164 and 165. This orientation of the bimetal element 320 is used when an NTC sensor is used for the temperature sensitive resistance element 321. With this type of sensor, heating and deflection of the bimetal element 320 is greatest at higher exhaust gas temperatures. The deflection of the bimetal element 320 away from the diaphragm reduces the effect of a given feedback pressure. Thus, with this arrangement the system is calibrated such that there is little or no excess air when there is little or no deflection of the bimetal element 320 at the lower firing rate. When the system operates at its higher firing rate, the tendency for fuel-rich combustion to occur is counteracted by reducing the effect of the feedback pressure, thereby reducing the relative rate of fuel supply as a result of the deflection of the strip 320 away from the diaphragm 163. The stop 331 limits the extent to which the rate of fuel supply can be reduced.

Referring now to FIG. 5, it can be seen that there are two ways to connect the circuit including the temperature sensitive element 312 and the heating element 324 to the secondary side of the transformer 210. One mode of connection places this circuit in parallel with the secondary; the other mode of connection places it in series. When the temperature sensitive element 321 is a PTC sensor, it is advantageous to use the series connection shown at the left hand side of FIG. 5. The series connection insures that when either thermostat 250 or 251 is turned on from a cold start, the heating element 324 and the bimetal element 320 are cold and the feedback pressure is not augmented. This causes a temporarily-reduced outlet gas pressure for the given level of feedback pressure and permits a high excess air condition to occur during start-up, despite the fact that exhaust gas temperatures will be low and exhaust gas density high at start-up. While the excess air condition is normally to be avoided, it can be helpful during start-up to reduce the tendency for condensation while the heat exchanger 30 is cold.

If the high excess air condition for start-up is not desired, the NTC sensor arrangement (connected in parallel with the secondary at circuit points 313 and 315) can be used and offers a certain advantage. In particular, a circuit failure (e.g., burned-out heating element) with an NTC sensor means that the system operates primarily at the minimal excess air condition for which the system is calibrated for low firing rates, because effective derating requires that a low firing rate be the primary operating mode. A circuit failure with the PTC sensor, on the other hand, might mean that no current reaches the heating element 324; in this case, the desired density compensation would not occur and the system would have high excess air in its primary operating mode, at low firing rates, although properly calibrated to provide low excess air for high firing rates.

d. Operation of Additional Features

An important safety feature of the present invention is performed by the second differential pressure sensor 94, best seen in FIGS. 1, 2*a* and 2*b*. When the stack blower 60 is operating normally, the stack exist pressure, as measured downstream from both the blower fan 62 and the orifice 70, should always remain substantially the same as atmospheric pressure. Under these conditions, the burner 40 should be permitted to turn on and off normally. However, should the stack 80 become blocked downstream from its connection to the conduit 95, a dangerous condition may arise and the burner 40 should not be used. In the present invention, the differential pressure sensor 94 and its associated switch 96, with contacts 96*a* (FIGS. 4 and 5), detect a blocked stack condition and ensure that the burner 40 will be shut down or not allowed to start a burning phase. This occurs as follows.

As described previously, the differential pressure sensor 94 and its associated switch 96 are designed such that the contacts 96*a* are normally closed. This state of the contacts exists whenever the stack exit pressure does not exceed the atmospheric pressure by more than a predetermined amount, e.g. 0.25 inches W.C. When the stack exit pressure exceeds atmospheric pressure by more than 0.25 inches W.C., the contacts 96*a* will open to totally cut off power from the secondary side of the transformer 210. The immediate effect of this is to deactivate the solenoid 112 to cut off the gas supply.

Among the enhancements or variations of the present invention are certain additional safety features. For example, the temperature sensor 57 may include a third, danger-condition, setpoint, at a temperature level higher than its setpoint to turn the fan 34 on and off, and second normally-closed contacts 59, actuated by the sensor 57 and placed in series with the primary side of the transformer 210, as shown in FIG. 4 and 5. The danger-condition setpoint is chosen such that an abnormally high heat exchanger temperature can be detected. When such a temperature is detected, the second, normally-closed contacts 59 are opened, cutting power to the primary side of the transformer 210, and the system is shut off. This avoids dangers caused by continued burning with an abnormally high heat-exchanger temperature.

A second additional safety feature which can be incorporated in the present control system is a pressure sensor which detects low outlet gas pressure, a condition which can sometimes lead to abnormal combustion in the burner 40. This low gas pressure sensor would sense pressure in the gas outlet pipe 104, and would only be enabled once a normal burning phase had started, so that it would not interfere with start-up. Activation of the low gas pressure sensor would cause the gas to be shut off and the rest of the system to be shut down normally, by a mechanism similar to that used in the case of stack blockage.

It will be obvious to one skilled in the art that a number of modifications can be made to the above-described embodiments without essentially changing the invention. For example, it is clear that other modulating gas valve designs could be used which perform essentially the same control function. Various solid-state sensors and switching devices may be substituted for certain bimetal thermostatic elements and the contacts and relays shown. It is also clear that the feedback pressure signal representing exhaust gas flow may be transmitted by other means, such as mechanical or electrical arrangements, and that data other than pressure which have the desired correspondence with exhaust gas flow rates, may be used in the feedback loop. Moreover, the induced draft blower and exhaust gas flow feedback concept could be adapted to various other kinds of heating systems, using other fuels, in which derating and regulating mass flow rates of the combustion input materials can affect system efficiency. One skilled in the art would further realize that various mechanical arrangements could be used to vary the orifice size for density compensation in the stack and to vary the balance of spring forces for density compensation in the fuel supply valve. One skilled in the art would also realize that the present invention can be used as a design for retrofitting existing furnaces, including natural draft furnaces, or as a design for the manufacture of new furnaces. Accordingly, while various embodiments of the invention have been illustrated and described, it is to be understood that the invention is not limited to the precise constructions herein disclosed, and the right is reserved to all changes and modifications coming within the scope of the invention as defined in the appended claims.

Having thus described the invention, what is claimed as new, and desired to be secured by Letters Patent, is:

1. In a heating system of the type having a combustion chamber with a fuel burner, an inlet for combustion air, and an exhaust stack for exhaust gas, the improvement comprising:

a blower connected to the exhaust stack for inducing exhaust gas flow through the exhaust stack and for drawing combustion air into the combustion chamber;

means for variably controlling the volume delivery rate of the blower such that volume flow of exhaust gas through the exhaust stack and of combustion air into the combustion chamber are simultaneously regulated;

variable fuel supply control means responsive to the volume flow of exhaust gas through the exhaust stack for supplying fuel to the burner at a rate linearly proportional to the volume flow of exhaust gas and combustion air such that the furnace can operate at higher and lower firing rates; and compensation means cooperating with the fuel supply control means and responsive to the density of the exhaust gas for modifying the rate of supplying fuel for a given volume flow of exhaust gas and combustion air when the exhaust gas density changes, whereby excess combustion air relative to fuel supplied at lower firing rates can be reduced.

2. The heating system as recited in claim 1 wherein the fuel supply control means comprises means adapted to be mounted in the exhaust stack for forming a flow restriction in the exhaust stack on one side of the blower and the compensation means comprises temperature sensitive means for modifying the flow restricting effect of the flow restriction means when the exhaust gas temperature changes.

3. The heating system as recited in claim 2 wherein the means for forming a flow restriction is an orifice in the exhaust stack and wherein the means for modifying the flow restricting effect comprises temperature sensitive means adjacent the orifice which partially obstructs flow through the orifice at lower firing rates and which moves so as to cause less flow obstruction at higher exhaust gas temperatures.

4. The heating system as recited in claim 3 further comprising a mechanical stop in the path of movement of said temperature sensitive means which establishes a maximum level of flow obstruction by the temperature sensitive means.

5. The heating system as recited in claim 4 wherein the temperature sensitive means is a bimetal element mounted in the stack adjacent the orifice which bends away from the orifice in response to increased exhaust gas temperatures.

6. The heating system as recited in claim 1 wherein the fuel burner is a gas burner; wherein the fuel supply control means comprises means for communicating a feedback pressure signal and a servoregulator valve which supplies fuel gas at a pressure level which is linearly proportional to a feedback pressure signal representative of the rate of flow of exhaust gas, which signal is communicated to the valve; and wherein the means for modifying the rate of supplying fuel comprises means for modifying the effect of the feedback pressure signal in the valve.

7. The heating system as recited in claim 6 wherein the servoregulator valve includes a servoregulator chamber divided by a spring-balanced diaphragm into two chambers, to one of which the feedback pressure signal is communicated, and wherein the means for modifying the effect of the feedback pressure signal comprises means for modifying the spring balance of the diaphragm.

8. In a heating system of the type having a combustion chamber with a fuel burner, an inlet for combustion air, and an exhaust stack for exhaust gas, the improvement comprising:

a blower connected to the exhaust stack for inducing exhaust gas flow through the exhaust stack and for drawing combustion air into the combustion chamber;

means for variably controlling the volume delivery rate of the blower such that volume flow of exhaust gas through the exhaust stack and of combustion air into the combustion chamber are simultaneously regulated;

variable fuel supply control means responsive to the volume flow of exhaust gas through the exhaust stack for supplying fuel to the burner at a rate linearly proportional to the volume flow of exhaust gas and combustion air such that the furnace can operate at higher and lower firing rates;

compensation means cooperating with the fuel supply control means and responsive to the density of the exhaust gas for modifying the rate of supplying fuel for a given volume flow of exhaust gas and combustion air when the exhaust gas density changes, whereby excess combustion air relative to fuel supplied at lower firing rates can be reduced, wherein the fuel burner is a gas burner; wherein the fuel supply control means comprises means for communicating a feedback pressure signal and a servoregulator valve which supplies fuel gas at a pressure level which is linearly proportional to a feedback pressure signal representative of the rate of flow of exhaust gas, which signal is communicated to the valve; and wherein the means for modifying the rate of supplying fuel comprises means for modifying the effect of the feedback pressure signal in the valve;

wherein the servoregulator valve includes a servoregulator chamber divided by a spring-balanced diaphragm into two chambers, to one of which the feedback pressure signal is communicated, and wherein the means for modifying the effect of the feedback pressure signal comprises means for modifying the spring balance of the diaphragm;

wherein the means for modifying the effect of the pressure feedback signal comprises movable bimetal means to which one of the diaphragm balancing springs is connected, and heating means responsive to the temperature of the exhaust gas and connected with said bimetal means, said heating means causing said bimetal means to move so as to modify the force exerted by said one spring on the diaphragm.

9. The heating system as recited in claim 8 wherein the heating means comprises:

a power source;

a temperature sensitive resistance in communication with the exhaust stack and connected in series with said power source; and an electrical resistance heater connected to said bimetal means and in series with the power source and temperature sensitive resistance.

10. The heating system as recited in claim 9 wherein the temperature sensitive resistance is a positive temperature coefficient resistance and said bimetal means increases the effect of a given feedback pressure signal in response to decreased exhaust gas temperatures.

11. The heating system as recited in claim 10 wherein the means for variably controlling the blower includes a thermostat with electrical contacts which close upon reaching the temperature set-point and the heating means is connected in series with the electrical contacts of the thermostat.

12. The heating system as recited in claim 9 wherein the temperature sensitive resistance is a negative temperature coefficient resistance and said bimetal means decreases the effect of a given feedback pressure signal in response to increased exhaust gas temperatures.

13. The heating system as recited in claim 12 wherein the means for variably controlling the blower includes a thermostat with electrical contacts which close upon reaching the temperature set-point and the heating means is connected in parallel with the electrical contacts of the thermostat.

14. In a heating system of the type having a combustion chamber with a fuel burner, an inlet for combustion air, and an exhaust stack for exhaust gas, the improvement comprising:

a blower connected to the exhaust stack for inducing exhaust gas flow through the exhaust stack and for drawing combustion air into the combustion chamber;

means for variably controlling the volume delivery rate of the blower such that volume flow of exhaust gas through the exhaust stack and of combustion air into the combustion chamber are simultaneously regulated;

variable fuel supply control means responsive to the volume flow of exhaust gas through the exhaust stack for supplying fuel to the burner at a rate linearly proportional to the volume flow of exhaust gas and combustion air such that the furnace can operate at higher and lower firing rates; and compensation means cooperating with the fuel supply control means and responsive to the temperature of the exhaust gas for modifying the rate of supplying fuel for a given volume flow of exhaust gas and combustion air when the exhaust gas temperature changes whereby excess combustion air relative to fuel supplied at lower firing rates can be reduced.

15. The system as recited in claim 14 wherein the compensation means for modifying the rate of supplying fuel comprises means for increasing the rate of supplying fuel in response to decreasing exhaust gas temperatures.

16. The system as recited in claim 14 wherein the compensation means for modifying the rate of supplying fuel comprises means for decreasing the rate of supplying fuel in response to increasing exhaust gas temperatures.

17. The system as recited in claim 14 wherein the compensation means for modifying the rate of supplying fuel comprises means for increasing the proportion of fuel relative to combustion air supplied to the fuel burner in response to decreasing exhaust gas temperatures so as to reduce excess combustion air.

18. A control system for a heating system having a combustion chamber with a fuel burner, an inlet for combustion air and an exhaust stack for exhaust gas from the combustion chamber comprising:

means connected to the exhaust stack for inducing exhaust gas flow through the exhaust stack and for drawing combustion air through the inlet into the combustion chamber;

flow sensing means for sensing the flow of exhaust gas through the exhaust stack; regulating means for regulating the rate of fuel supply to the fuel burner;

first means connecting said flow sensing means to said regulating means for regulating the rate of fuel supply to the burner in response to the flow of exhaust gas out of the exhaust stack;

density sensing means for sensing a parameter indicative of the density of the exhaust gas; and second means connecting said density sensing means to said regulating means for regulating the rate of fuel supply to compensate for changes in exhaust gas density as these affect the ratio of combustion air to fuel supplied to the fuel burner.

* * * * *